United States Patent [19]

Legille et al.

[11] Patent Number: 4,493,600

[45] Date of Patent: Jan. 15, 1985

[54] FURNACE CHARGING SYSTEM

[75] Inventors: Edouard Legille, Luxembourg; Pierre Mailliet, Howald, both of Luxembourg

[73] Assignee: Paul Wurth S.A., Luxembourg, Luxembourg

[21] Appl. No.: 368,365

[22] Filed: Apr. 14, 1982

[30] Foreign Application Priority Data

May 18, 1981 [LU] Luxembourg ..... 83370

[51] Int. Cl.[3] ..... F27B 1/20

[52] U.S. Cl. ..... 414/208; 266/176; 414/206

[58] Field of Search ..... 414/160, 299, 300, 5, 414/730, 205, 206, 208, 301, 293; 266/176; 193/16, 23; 239/73

[56] References Cited

U.S. PATENT DOCUMENTS 4,243,351 1/1981 Legille et al. ..... 193/16 X 4,306,827 12/1981 Tsutsumi et al. ..... 266/176 X

FOREIGN PATENT DOCUMENTS 2104116 8/1972 Fed. Rep. of Germany ..... 325/266

*Primary Examiner*—Robert J. Spar

*Assistant Examiner*—Janice Krizek

*Attorney, Agent, or Firm*—Fishman & Dionne

[57] ABSTRACT

The movements of an oscillatory member, for example the charge distribution spout of a furnace charging system, are caused to follow the movements of a remotely located control device which may be in the form of an elongated arm. The spout and arm are rotatable about respective pairs of orthogonal axes and any angular deviations between the orientation of the control device arm and spout axis are sensed. Control signals commensurate with the angular deviations are delivered to fluidic actuators which reposition the spout.

19 Claims, 12 Drawing Figures

Fig. 3a
Fig. 3
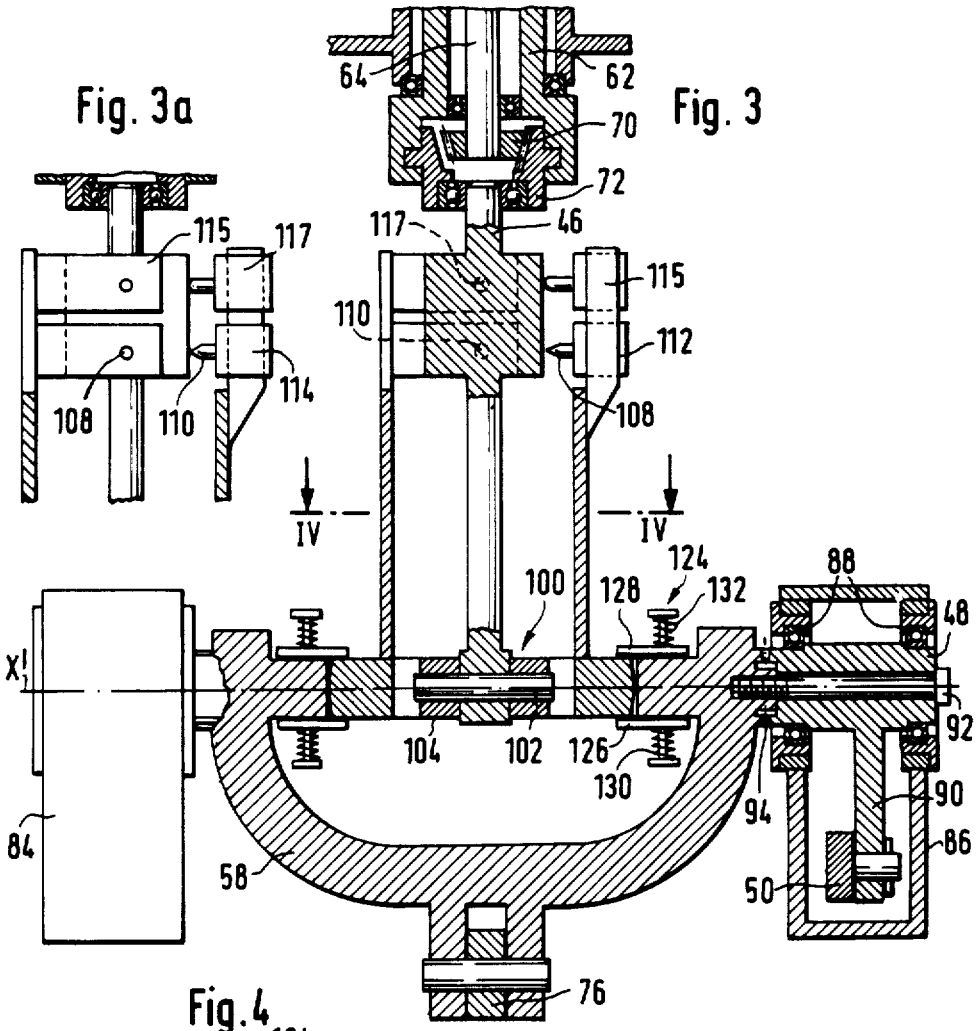
Fig. 4
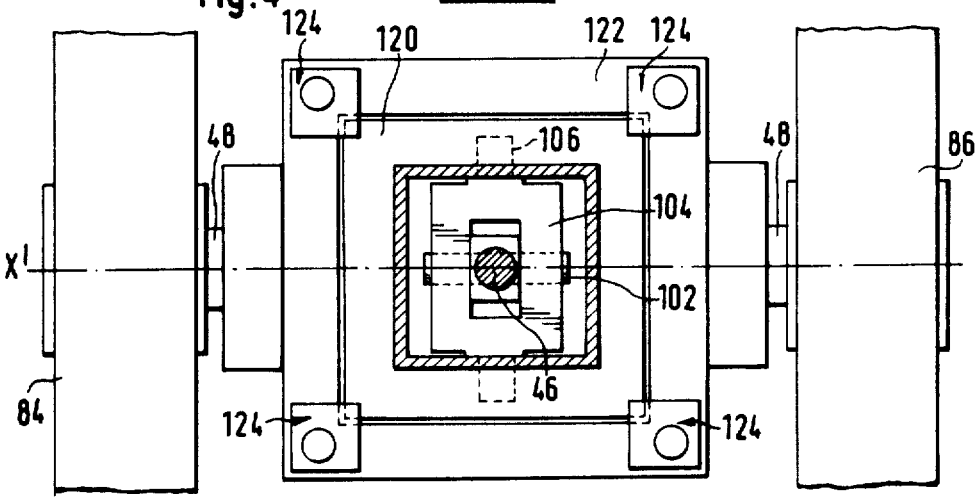

FURNACE CHARGING SYSTEM

BACKGROUND OF THE INVENTION

1. Field of the Invention

The present invention relates to the exercise of remote control over the position, with respect to a pair of transverse axes, of an elongated member and particularly a material distribution chute located within a hostile environment. More specifically, this invention is directed to apparatus for controlling the position of a tubular spout and especially a charge distribution spout located within a pressurized furnace. Accordingly, the general objects of the present invention are to provide novel and improved apparatus and methods of such character.

2. Description of the Prior Art

The present invention is particularly well suited for use in exercising control over the delivery of granular charge material to the hearth of a blast furnace via a tubular distribution spout, suspended within the furnace, which is capable of pivoting about a pair of orthogonal axes. For a general discussion of blast furnace charging installations, reference may be had to our co-pending application Ser. No. 288,974, filed July 31, 1981, and to the publications incorporated therein by reference. Application Ser. No. 288,974 also discloses a furnace charge spout steering mechanism comprising a control device located outside of the furnace which assumes the same orientation as the spout itself. Motions imparted to the control device of the co-pending application are coupled to the spout by means of a unique transmission mechanism to thereby cause the spout to continuously assume the same position and orientation as the control device. In the apparatus of application Ser. No. 288,974, the movements of the control device are directly transmitted to the spout by mechanical means. Such mechanical coupling results in considerable mechanical stresses being imposed on the control device due to the mass of the spout and its suspension mechanism. While the control device may be designed to withstand these mechanical stresses, thus providing a reliable charge distribution system, there has been a desire in the art for a control device of lighter construction.

SUMMARY OF THE INVENTION

The present invention provides novel and improved apparatus for exercising control over the movements of an oscillating spout from a remote location and particularly improved apparatus for causing the discharge end of an oscillatory charge distribution spout to transcribe concentric circles or a spiral. The invention thus comprises an improvement to the apparatus of co-pending application Ser. No. 288,974 wherein the mechanical stresses imposed on the control device are greatly diminished.

Apparatus in accordance with the present invention includes means for causing the distribution spout to pivot about first and second mutually orthogonal axes, a remotely located control device and a servo device coupled to both the control device and the means which impart pivoting motion to the spout. The servo device controls the means which causes the pivoting of the spout such that the spout will follow the movements of the control device.

In accordance with a preferred embodiment of the invention, the means for causing the spout to pivot about the two transverse axes comprise a pair of fluidic actuators.

In accordance with one embodiment of the invention the control device comprises an elongated arm having its first end coupled to a rotary shaft which is, in turn, mounted on the suspension fork of the distribution spout. This rotary shaft is oriented parallel with respect to a first of the spout pivot axes and is coupled thereto by means of a transmission device. The connections are such that the arm pivots synchronously with, and thus follows, the pivoting movements of the spout about the first axis as caused by a first of the actuators. The second end of the arm is caused to follow the movements of a driving mechanism, the driving mechanism being designed to impart a conical movement of circular precession, with a variable angle of inclination, to the control device arm second end.

Continuing to discuss the first embodiment of the invention, the means by which the control device, particularly the arm, is coupled to the rotary shaft comprises a universal joint. A pair of sensors, supported from the rotary shaft, are provided to detect any pivoting movement of the control device about a pair of axes which are respectively parallel to the spout pivot axes, such pivoting movement being between the arm and the rotary shaft. The sensors provide error signals which may be used to control the fluidic actuators. Thus, in operation, any deviation from parallelism between the axis of the spout and the control device arm, which may be produced and which is permitted by the universal joint, will be sensed and, through the exercise of control over the actuators, the spout will be moved to reestablish parallelism. The axis of the spout thus will always remain parallel to that of the control device arm and will follow the movements imparted to the control device by its driving mechanism.

In accordance with the present invention the driving mechanism for the control device may be a "miniaturized" mechanism since the only force which it is required to develop is that necessary to cause the control device arm to pivot in its universal joint connection to the rotary shaft.

It is to be noted that, in accordance with the above-described embodiment, the first of the spout motion causing fluidic actuators is journalled to the suspension fork for the spout while the second actuator is journalled to a fixed position frame which supports the suspension fork.

In accordance with a preferred embodiment of the invention a safety system comprising an elastic "socket" is interposed between the control device and the motion transmission device. This safety system is designed to prevent damage to any of the components of the system in the case of a failure of the driving mechanism or either of the fluidic actuators. The safety system may include one or more limit switches which detect movements of greater magnitude than those which the above-mentioned sensors are designed to detect.

In accordance with a second embodiment, the control device is completely independent of the spout and the means for imparting motion thereto but is nevertheless mounted in such a manner that it can perform the same movements as the spout. In this second embodiment the pivoting movements of the control device about two perpendicular axes are electronically sensed and control signals commensurate with these movements are generated. The actual position of the spout is also sensed and electrical signals commensurate therewith produced. The signals commensurate with actual spout position and control device position are compared and any error signals are employed to control the fluidic actuators whereby the spout will be repositioned until the error signals have been nulled.

The present invention also contemplates a shaft furnace charging installation comprising a vertical feed channel, mounted in the head of the furnace and coaxial therewith, which connects one or more external charge storage hoppers to the furnace interior. The charging installation of the present invention includes an oscillating charge distribution spout, positioned below with its receiving end in registration with the feed channel, and suspension and control devices for the oscillating spout.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIG. 3 is a view, on an enlarged scale, taken along line III—III of FIG. 1;

FIG. 3*a* is a partial cross-sectional view of the apparatus of FIG. 3, the view of FIG. 3*a* being taken transverse to that of FIG. 3;

FIG. 4 is a view taken along line IV—IV of FIG. 3 illustrating a first embodiment of a safety device for use in the present invention;

DESCRIPTION OF THE PREFERRED EMBODIMENTS

Figure 1:
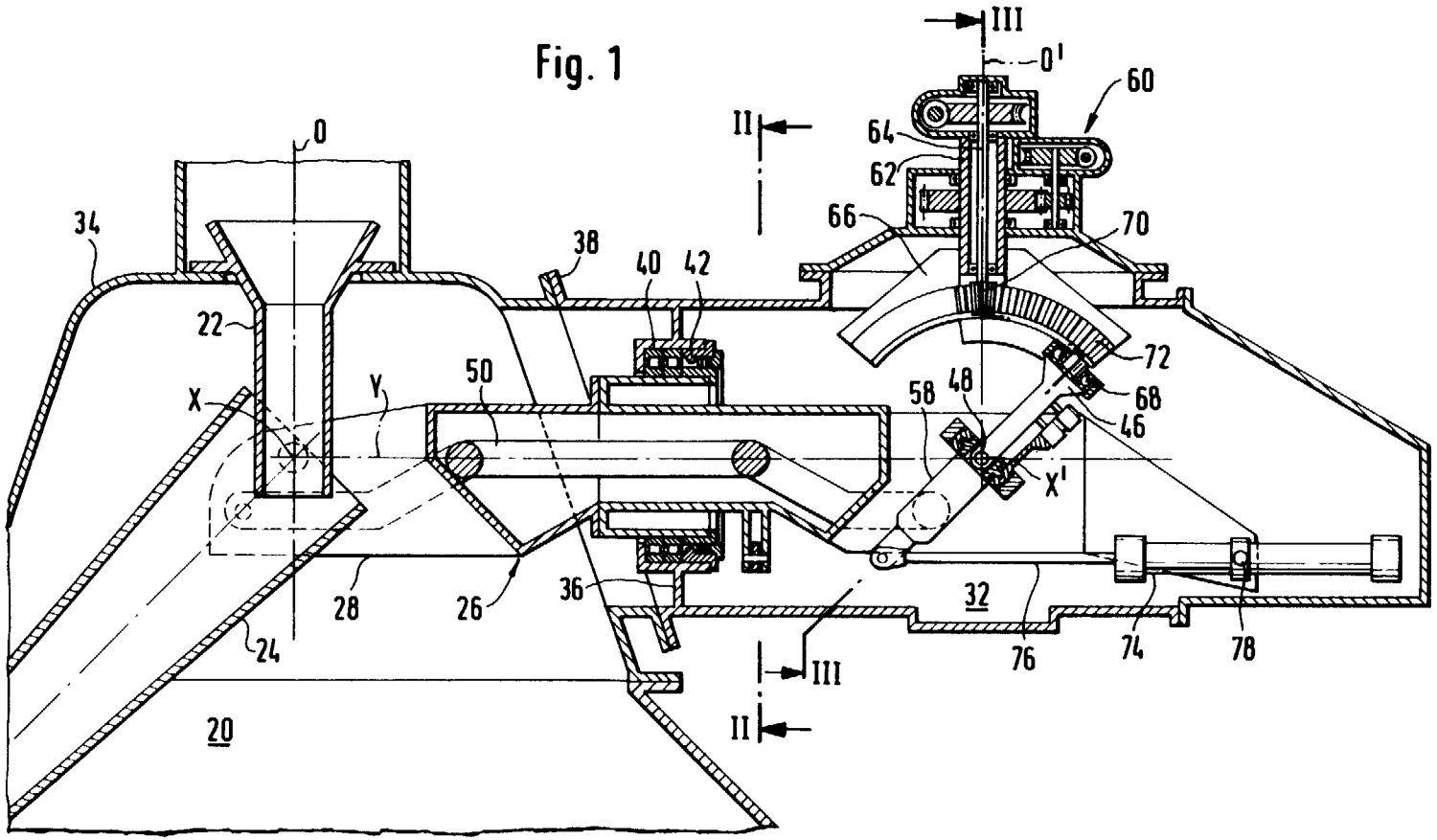
FIG. 1 is a schematic, side elevation view of a furnace charging installation in accordance with a first embodiment of the present invention.

With reference now to the drawings, FIG. 1 schematically represents a portion of a blast furnace charging installation including a steerable charge distribution spout 24 which is mounted in the head 20 of the furnace. The spout and its suspension mechanism correspond to that shown in FIG. 1 of referenced co-pending application Ser. No. 288,974 and it is to be noted that like reference numerals have been employed to designate like elements in the present and co-pending applications. It is also to be noted that, while described in the environment of a charging installation for a pressurized shaft furnace, the present invention could be utilized to control the motion of any pivotally suspended member located within an enclosure subject to inhospitable conditions such as those prevailing in a blast furnace.

Continuing to refer to FIG. 1, the material with which the furnace is to be charged is delivered, from a storage hopper, not shown, to the upper end of the spout 24 via a vertical feed channel 22. Feed channel 22 is coaxial with the furnace axis O. The spout 24 is, as shown, preferably in the shape of a truncated cone. Spout 24 is suspended between the two branches of a fork, indicated generally at 26. A first of the branches of fork 26 is indicated at 28. The attachment of spout 24 to fork 26 is such that the spout may pivot about a first horizontal axis X which intersects the furnace axis O. The fork 26 is mounted in the side wall of a carcass or extension 34 of furnace head 20 such that it may rotate about the longitudinal axis Y defined by its body portion. As shown in FIG. 1, axis Y is also horizontally oriented and intersects axes X and O. Rotation of fork 26 will cause spout 24 to rotate about axis Y and, in the manner to be described below, the spout may simultaneously and independently be caused to rotate about axis X.

The furnace carcass 34 is provided with an opening which terminates in a flange 38. A control device housing 32 is affixed to and supported from flange 38. The fork 26 passes through a wall 36 which separates the interior of the main portion of housing 32 from the interior of the furnace. Rotation of fork 26 within wall 36 is permitted through the use of bearings 40. A hermetic seal between the interior of the furnace and the interior of housing 32 is insured through the use of sealing devices 42. It is to be noted that the penetration of the dirty furnace gases into housing 32 may also be prevented by maintaining a pressure within housing 32 which is equal to or greater than the pressure prevailing within the furnace head 20.

A "control device" 46 is positioned within housing 32. Control device 46 is coupled to a rotary shaft 48 which passes through an extension of fork 26. Shaft 48 is capable of rotation about its axis X′ which is parallel to the pivot axis X of spout 24. Since it passes through the fork 26, the shaft 48 must also be capable of rotation with spout 24 about axis Y. Control device 46 is thus pivotal together with shaft 48 about axis X′ and about axis Y. Accordingly, the control device and spout will have the same degrees of freedom of motion and the movements of one may be caused to follow the movements of the other.

In accordance with the teachings of co-pending application Ser. No. 288,974, the movements which the operator desires spout 24 to perform are imparted to the control device 46. Thus, the motions of the control device must be transmitted to the spout. For this purpose a transmission device 50 passes through the fork 26, the intermediate portion of fork 26 being of tubular construction to accomodate transmission device 50. A first end of the transmission device 50 is connected, either directly or indirectly, to the spout. The second end of the transmission device 50 is connected, by means of a lever, to the control device 46. The entire connection system, including fork 26, thus comprises a parallelagram type linkage which converts the pivoting movements of control device 46 about axis X′ to a pivoting movement of spout 24 about axis X.

Application Ser. No. 288,974 proposes several alternative means for imparting the required movements to control device 46. FIG. 1 of the instant application corresponds to that version of the driving mechanism for the control device which is illustrated in FIG. 1 of application Ser. No. 288,974. Thus, the driving mechanism comprises a motor subassembly, indicated generally at 60, which is mounted on the exterior of housing 32 and, preferably, detachable therefrom. Coaxial control shafts 62 and 64 extend from the motor subassembly 60, through bearings and seals, to the interior of housing 32. One of these control shafts, the outer shaft 62 in the embodiment being described, is connected to a slide bar 66 which has the form of a circular arc. The angle transcribed by the arc of bar 66 is equal to twice the maximum angle of inclination of spout 24 relative to furnace axis O. A pinion gear 70 is affixed to the end of the inner shaft 64. Pinion 70 cooperates with a sector gear 72 which is mounted on slide bar 66 in such a manner that it can move relative thereto about its axis. A rotary connection 68 is provided between the end of control device 46 and a first end of the sector 72.

Rotation of outer control shaft 62 will cause slide bar 66 and thus sector 72 to rotate about axis O' which is parallel to the furnace axis O. This motion of sector 72, as a result of the rotary connection 68 to control device 46, will result in the conical precession of control device 46 about axis O'. This precessional movement of the control device 46 is rendered possible by coordinating pivoting movements of fork 26 about axis Y and movements of device 46 about axis X'. Thus, in the manner to be described in more detail below, the conical precession movement of device 46 will be accurately reproduced as motion of spout 24. The rotation of the inner control shaft 64 extending from motor subassembly 60 will move the sector 72 and thereby modify the angle of inclination of control device 46 relative to axis O'.

The above-described movements are more fully discussed in application Ser. No. 288,974. In the apparatus of the said co-pending application the control device 46 forms both a control function and a driving function, i.e., the control device directly actuates the spout 24 via a series of levers. The control device 46 and its connection with its driving mechanism will, accordingly, be subjected to mechanical stresses of considerable magnitude. In order to eliminate these mechanical stresses the present invention removes the driving function from control device 46 whereby it functions merely as a control, i.e., servo, mechanism. Thus, in accordance with the embodiment of the present invention depicted in FIG. 1, the forces required for producing the pivoting movements of fork 26 and spout 24 is derived from fluidic actuators.

In FIG. 1 a first of the above-mentioned fluidic actuators, in the form of a hydraulic jack, is indicated at 74. The piston rod 76 of jack 74 is coupled to a lever 58 which is affixed to the rotary shaft 48. The transmission device 50 is articulated to lever 58. Accordingly, jack 74 may cause the control device 46 to pivot about axis X' and, simultaneously, will cause the spout 24 to pivot about axis X in its suspension. The end of piston rod 76 which is articulated to lever 58 is required to perform a pendular movement about axis X' and thus jack 74 must be capable of pivoting about an axis which is parallel to axis X'. The requisite pivoting movement of jack 74 is permitted by means of mounting jack 74 in journals 78 positioned outwardly with respect to the end of fork 26.

Figure 2:
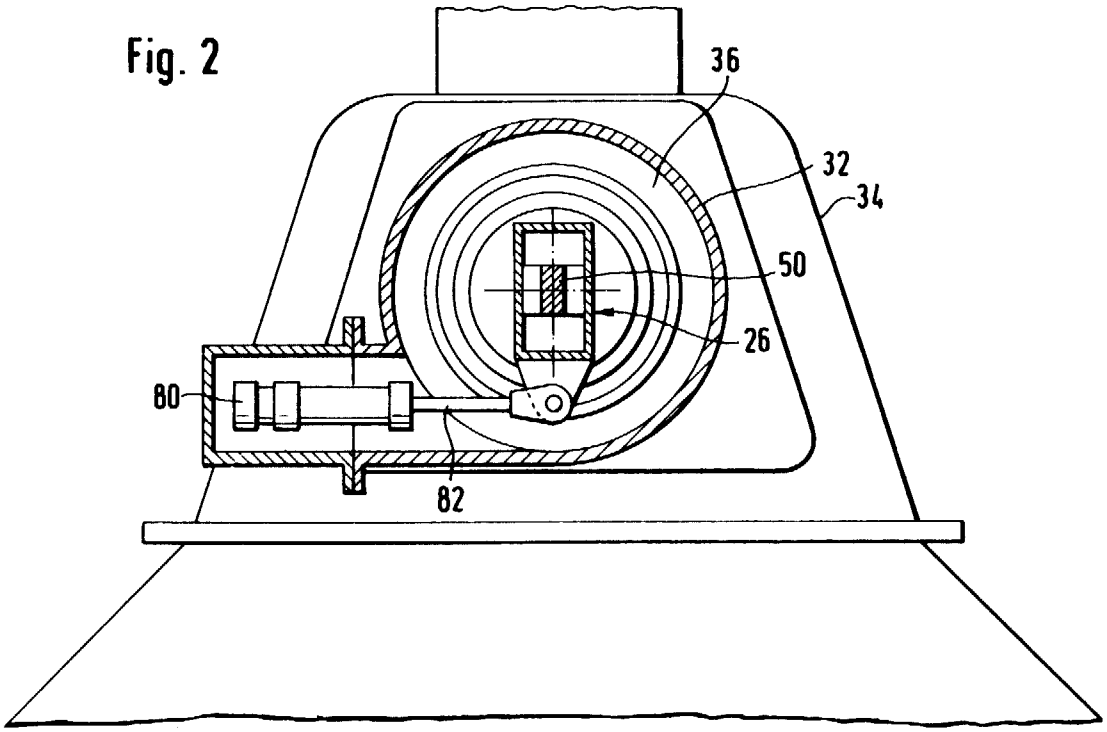
FIG. 2 is a schematic view taken along line II—II of FIG. 1.

A second hydraulic jack 80, which is visible in FIG. 2, acts in a direction which is perpendicular to the direction of movement of the piston rod of jack 74. Jack 80 is mounted by means of journals, not shown in the drawing, from the inner wall of enclosure 32. The end of the piston rod 82 of jack 80 is directly articulated to fork 26 and thus the actuation of jack 80 will cause fork 26 to rotate about its axis Y in bearings 40.

As is implicit in the above discussion, fork 26 is actually a double fork which includes the two branches 28 between which spout 24 is suspended and, at its opposite end, two branches 84 and 86 which provide support for rotary shaft 48. Fork 26 may thus be considered similar to the device depicted in FIGS. 27 and 28 of co-pending application Ser. No. 288,974.

FIG. 3 shows the manner in which the rotary shaft 48 is mounted between the branches 84 and 86 of fork 26, only branch 86 having been shown in cross-section. Bearings 88 are provided so as to permit the rotation of shaft 48 about axis X' while sealing means, not shown in the drawing, permit the circulation of a coolant inside the entire fork 26. The pivoting, i.e., rotational, movements of shaft 48 are converted into a translational movement of the transmission mechanism 50, which will also preferably be in the form of a double fork, by means of levers 90 which are integral with shaft 48.

In order to facilitate assembly and disassembly, it is preferable to form shaft 48 from a number of components. In the embodiment of FIG. 3 these components comprise a pair of stubs, which include the levers 90, provided with through holes for receiving bolts 92. The threaded end of bolt 92 engages a socket provided therefore in lever 58 and, at the mating surfaces of the stub and lever, the two parts are preferably provided with side plates having interlocking lands and grooves.

Control device 46 is coupled to shaft 48 by means of a universal joint which has been indicated generally at 100. The universal joint 100 may take numerous forms such as, for example, a balljoint. In the drawing a Cardan type joint is disclosed. The control device 46 is affixed, at a first end thereof, to a shaft 102 which is received in a frame 104. As may be seen from joint consideration of FIGS. 3 and 4, frame 104 is, in turn, supported by pivots 106 which enable the frame to rotate about a second axis perpendicular to axis X'.

The movements which occur in joint 100, either as a result of the action of the motor subassembly 60 or as a result of motion of spout 24, are detected by sensors 108 and 110 which are associated with control device 46 and integral with shaft 48. The sensors 108 and 110 may comprise the plungers of transducers 112 and 114. The transducers will provide output signals commensurate in magnitude with any deviation of control device 46 from a neutral position. Thus, the sensor 108 will detect a change in position resulting from movement about pivots 106 and, in the manner to be described below, a control signal will be produced which will activate the jack 80. The sensor 110, which is offset with respect to sensor 108 by an angle of 90°, is responsive to movements about axis X' and the output signal provided by transducer 114 in response to movement of sensor 108 will be a command signal for the energization of the hydraulic jack 74.

Figure 6:
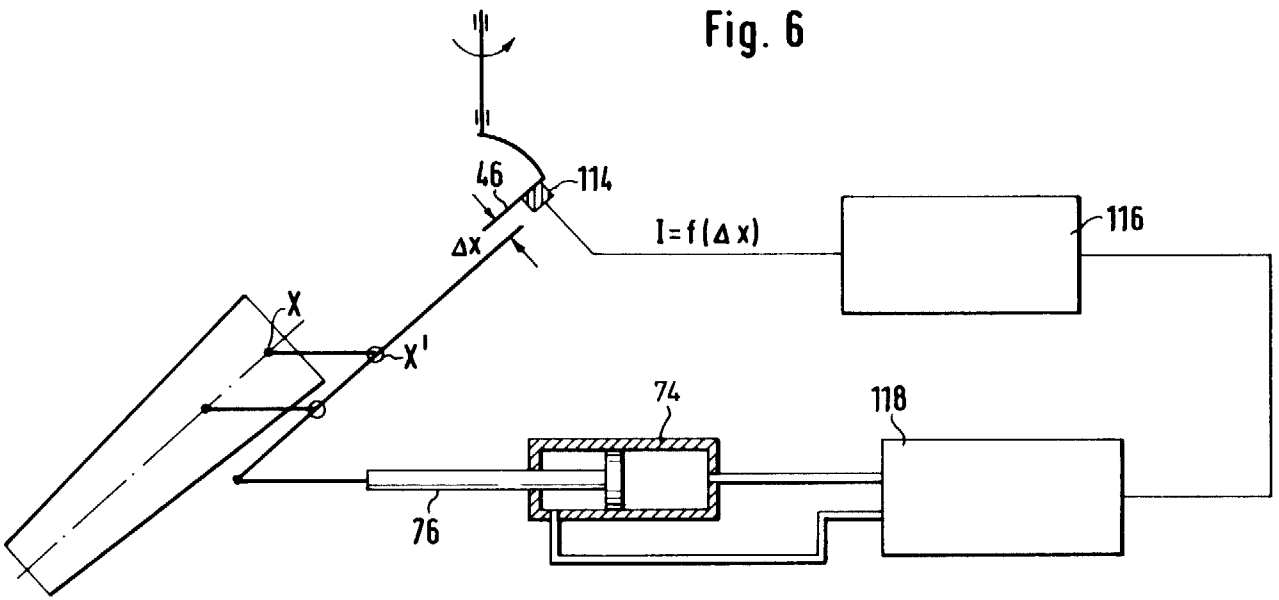
FIG. 6 is a functional block diagram which depicts operation of the embodiment of FIG. 1, FIG. 6 representing the control circuitry for the actuators of the FIG. 1 embodiment.
Figure 7:
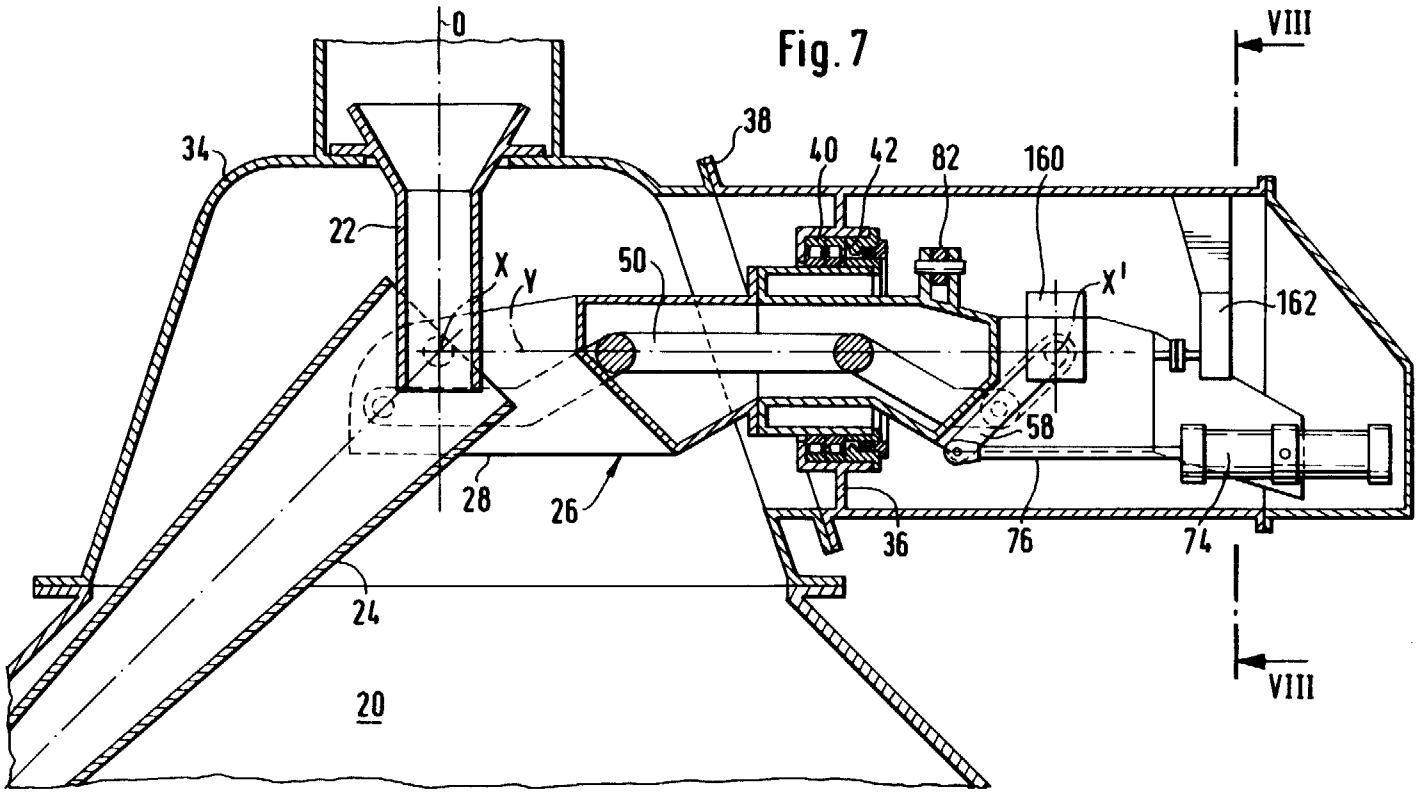
FIG. 7 is a view similar to FIG. 1 depicting a second embodiment of the present invention.
Figure 8:
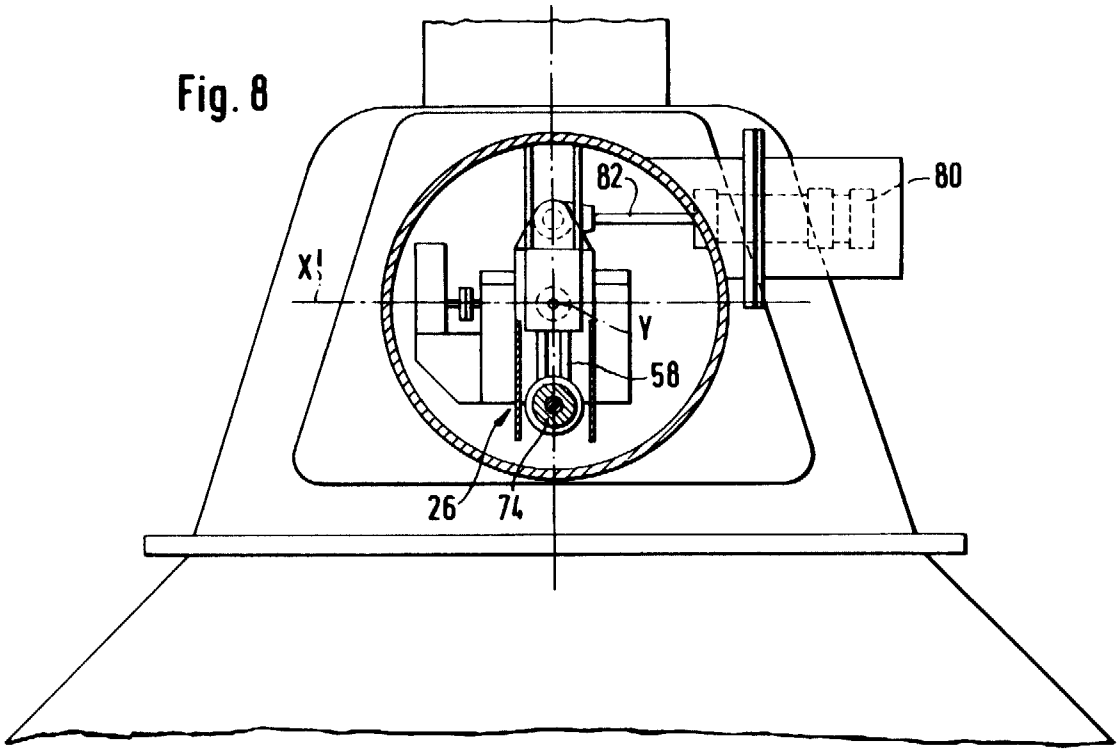
FIG. 8 is a view taken along line VIII—VIII of FIG. 7.

Referring now to FIG. 6, when the action of the motor subassembly on control device 46, or the action of spout 24 on shaft 48, causes or allows a displacement $\Delta x$ of control device 46 from a previous "neutral" position, transducer 114 will generate an electrical signal $I=f(\Delta x)$. The output signal of transducer 114 will be a function of the difference between the actual position of the sensor 110 and its previous neutral position and the signal may be either positive or negative according to the direction of movement of the control device relative to transducer 114 which, as noted above, is affixed to shaft 48. The signal I is delivered to a proportional regulator 116, which may be a proportional integral differential regulator of the type known in the art. Regulator 116 provides an output signal which actuates a hydraulic servo control device 118 which will typically comprise a slide valve. The hydraulic control 118 will be incorporated in the hydraulic circuit of jack 74. Movement of the valve member in control 118, in response to the electrical output signal of regulator 116, will unbalance the pressure in the cylinder of jack 74 and the resultant flow of hydraulic fluid will reposition the piston of the jack in the appropriate direction to impart movement, via the mechanical linkages, to the spout in a direction appropriate to cause the signal I to return to its initial level. Thus, the hydraulic jack 74 will produce a motion of spout 24 which will be in the opposite direction to the action which produced the displacement $\Delta x$ of the sensor. The control unit 118 is designed so that it will vary the rate of delivery of hydraulic fluid to jack 74 as a function of the magnitude of the signal I. Thus, the speed of the spout movement produced as a response of the actuation of jack 74 will be a function of the magnitude of the displacement $\Delta x$.

It will be understood that a second control circuit similar to that shown in FIG. 6 will be associated with sensor 108 in order to control the hydraulic jack 80 thus the pivoting movement of spout 24 about axis Y.

As noted above, the sensors 108 and 110 are responsive to the dual action of the control device 46 and, via fork 26 and shaft 48, spout 24. The sensors receive, from control device 46, control information as a result of the action of the motor subassembly. The sensors 108 and 110 also continuously receive information commensurate with the actual position of spout 24. Whenever the real position information fails to correspond with the commanded position as established by the control device, one or both of transducers 112 and 114 will provide output signals I which, as noted above, will result in motion being imparted to the spout to reduce the I signals. Thus, the position or orientation of spout 24 is automatically controlled to cause the spout to follow the motion of the control device as commanded by the output of the motor subassembly 60.

Should there be a component failure in the system either at the motor subassembly or spout side of the control device, i.e., as a result of an electrical problem in the motor subassembly or a failure in the hydraulic circuits for jacks 78 and 80, the servo control system will be incapable of nullifying an error signal I. Accordingly, a $\Delta x$ displacement would tend to increase in an uncontrolled manner. In order to prevent this from happening, safety sensors 115 and 117 are juxtapositioned to the transducers 112 and 114. These safety devices, which may be identical in construction to the displacement sensors and associated transducers, will provide an output signal when the value of $\Delta x$ exceeds a predetermined threshold. The output signals from the safety devices 115 and 117 will cause the deenergization of the motor subassembly and the blocking of the hydraulic circuit.

In order to insure that the safety devices 115 and 117 will not inopportunely disable the control, particularly as a result of the inherent delay between sensing of a $\Delta x$ displacement and the repositioning of the spout, additional safety devices are provided. A first embodiment of these additional safety devices is depicted in FIGS. 3 and 4 while a second embodiment thereof is shown in FIG. 5.

Referring again to FIGS. 3 and 4, the joint 100 is positioned within a frame 120 which, in turn, is located within a further frame 122. The outer frame 122 is affixed to the rotary shaft 48. The frames 120 and 122 are held together solely by means of four pair of elastic securing devices, indicated generally at 124, which are provided at the four corners of the frames. Each of these securing devices will comprise, by way of example, a pair of plates 126 and 128 which, as may be seen from FIG. 3, cover the joint between the frames. The plates 126 and 128 are respectively maintained in position by the action of springs 130 and 132. The springs 130 and 132 will be sufficiently strong to maintain the relationship illustrated in FIGS. 3 and 4 under normal operating conditions. However, when an exceptional force is exerted on one of the two frames, and the other frame is unable to follow the movement produced by said force, the bias of one spring or set of springs will be overcome causing the plate to move away from the frames and permitting the disengagement of the frames from one another without risk of breakage.

To further discuss the operation of the additional safety devices 124, a leak in a hydraulic circuit for one of the jacks 74 or 80 would prevent the jack from maintaining the spout in the desired position and the spout, under the influence of its own weight, would tend to tilt into the vertical position. Such tilting would normally be transmitted to the control device 46 which would be held in the desired orientation by means of the output of the motor subassembly. The control device 46 and its driving mechanism are unable to support a force resulting from a failure of control over spout 24 and thus, without the above-described safety system, serious damage to the control system would necessarily occur. However, in accordance with the present invention, the imposition of the weight of the spout on the servo control will merely result in the disengagement of frames 120 and 122 and these components may be easily reassembled when the appropriate corrective action has been taken.

Figure 5:
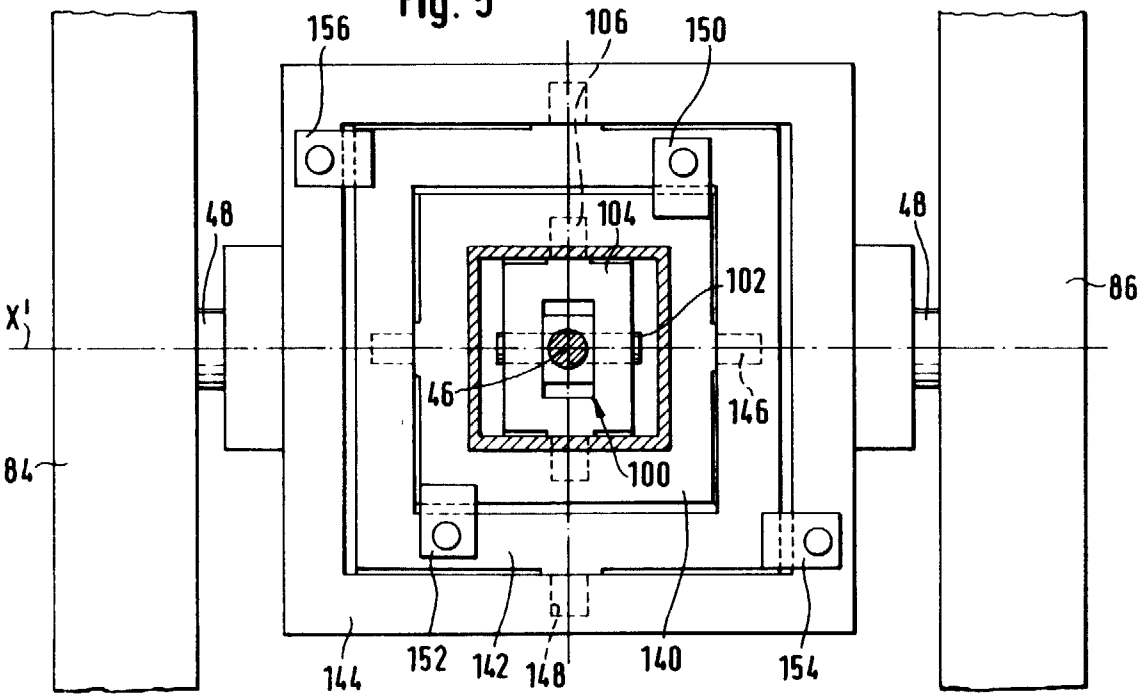
FIG. 5 is a view similar to FIG. 4 showing a second embodiment of a safety device.

FIG. 5 represents a modified version of the safety device of FIGS. 3 and 4. In the FIG. 5 embodiment the universal joint 100 is supported within an inner frame 140 while the control device 46 is secured within an outer frame 144 which is integral with rotary shaft 48. The connection between control device 46 and outer frame 144 is in the form of an elastic device of the Cardan joint type. Thus, an intermediate frame 142 is provided between frames 140 and 144. Inner frame 140 is pivotal about a shaft 146, corresponding to axis X', within intermediate frame 142. The intermediate frame 142, in turn, may pivot within the outer frame 144 about the axis of shaft 148 which is perpendicular to the axis of shaft 146. This structure, i.e., the three coaxial frames, is held together by a series of elastic securing devices which may be similar to the plate and spring type devices 124 of FIGS. 3 and 4. Two securing devices 150 and 152 hold the inner frame 140 in position with respect to intermediate frame 142 and prevent rotation about shaft 146. Two additional securing devices 154 and 156 prevent intermediate frame 142 from rotating within outer frame 144 on shaft 148.

As in the embodiment of FIGS. 3 and 4, in the FIG. 5 embodiment the securing devices may yield, thus permitting the frames to disengage from one another by rotation about shafts 146 and/or 148. However, in the embodiment of FIG. 5 the frames do not completely separate but merely rotate relative to one another about the pivot shafts 146 and 148. Thus, upon resumption of normal operation, all that is necessary when employing the FIG. 5 safety system is to pivot the various frames back to their initial position where they will be retained by the elastic securing devices.

It is particularly to be noted that other safety systems which provide the above-described functions could be employed. By way of example, instead of providing the safety system between control device 46 and fork 26, a safety system could be inserted between control device 46 and the driving mechanism therefore. A safety system of this kind could, for example, take the form of friction clutches on the control shafts or between the control shafts and their respective drive motors.

A second embodiment of the present invention is illustrated in FIGS. 7–10. In the embodiment of FIGS. 7–10 there is no mechanical connection between the control device and its drive mechanism and the suspension of spout 24. While like reference numerals have been employed to refer to like elements in FIGS. 1 and 7, it is to be noted that hydraulic jack 80 occupies a different position in the two embodiments while performing the same function.

Figure 9:
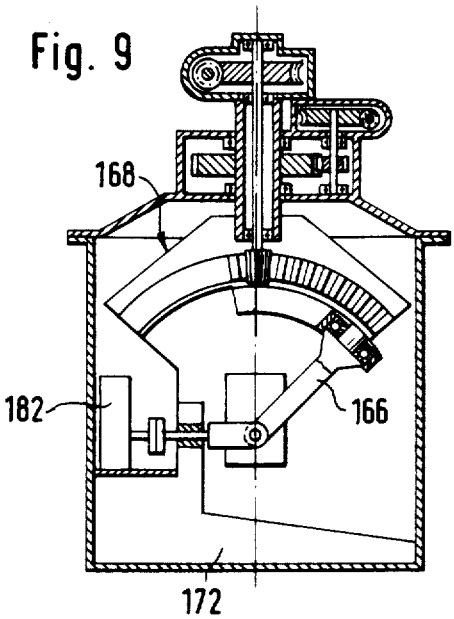
FIG. 9 is a schematic diagram of a control device and driving mechanism which may be associated with the embodiment of FIGS. 7 and 8.
Figure 10:
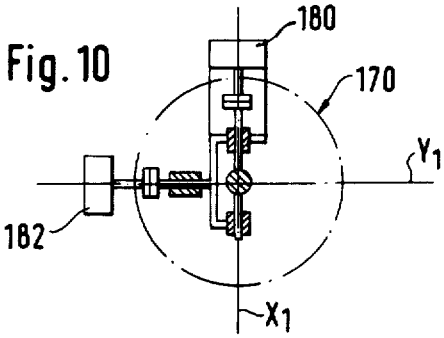
FIG. 10 is a schematic view which illustrates the operation of the apparatus of FIG. 9.

In the embodiment of FIGS. 7–10 the orientation of the spout 24 is monitored by means of position sensors 160 and 162. Sensor 160 determines the angular position of the spout relative to axis O. This angular position corresponds to the angle between lever 58 and axis X'. Thus, position sensor 160 provides output signals commensurate with the pivoting movements of spout 24 about axis X. Similarly, sensor 162 will provide output signals commensurate with the rotation of fork 26, and thus also of spout 24, about axis Y. FIGS. 9 and 10 schematically represent a control mechanism, including a control device 166, which can be located in any desired position such as, for example, in a control room. The control device 166 is actuated by a suitable drive mechanism 168 which may be similar to the mechanism described above in the discussion of FIG. 1 or one of the other different constructional versions thereof as described in co-pending application Ser. No. 288,974. The control device 166, as schematically illustrated in the drawing, is supported on a suitable frame 172 by means of a universal joint system which, as shown in FIG. 10, will be a Cardan type joint which has been indicated generally at 170. The universal joint 170 enables the control device 166 to pivot about perpendicular axes $X_1$ and $Y_1$. The axes $X_1$ and $Y_1$, of course, correspond respectively to the pivot axes X and Y of spout 24 in furnace head 20.

Figure 11:
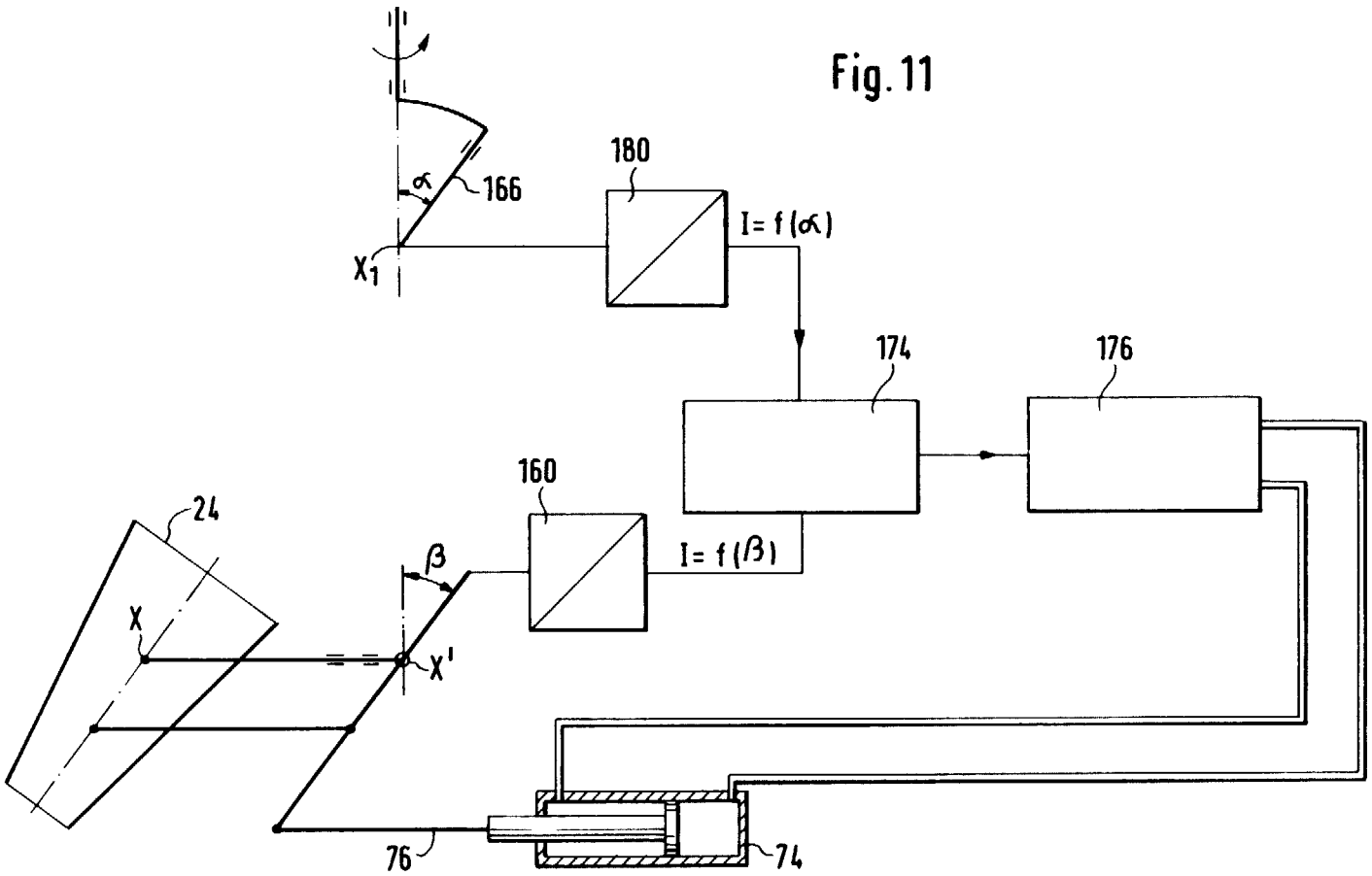
FIG. 11 is a functional block diagram depicting the operation of the embodiment of FIGS. 7-10.

The movements of control device 166, for example a conical precession movement, will be monitored and employed to provide instructions for the desired movements of the spout. These instructions will be in the form of control signals which represent the angular movements of control device 166 about axes $X_1$ and $Y_1$ in Cardan joint 170. The angular movements of control device 166 are detected by position sensors 180 and 182. Referring to FIG. 11, the operation of the embodiment of FIGS. 7–10 with respect to one degree of movement of spout 24 is shown by means of a functional block diagram. There will, of course, be a control system which is substantially identical to that of FIG. 11 for supervising the second degree of motion, i.e., for controlling the hydraulic jack 80.

For purposes of explanation it will be presumed that control device 166 has been rotated about axis $X_1$ through an angle $\alpha$. This is the control value for the spout, i.e., the angle of inclination $\beta$ which the spout must occupy relative to the vertical furnace axis O. The pivoting movement of control device 166 about axis $X_1$ is detected by position sensor 180 which generates an electrical output signal $I=f(\alpha)$. The magnitude and/or polarity of the signal I will be a function of the amplitude and direction of the pivoting movement which is to be imparted to the spout if spout 24 is inclined at an angle $\beta$ with respect to axis O when the control device 166 is pivoted about axis $X_1$ to its new position. The angular orientation of spout 24 is sensed by means of a position sensor 160 which produces the output signal $I=f(\beta)$. The signals generated by position sensors 160 and 180 are compared in a regulator circuit 174 which produces an output error signal. This error signal is delivered as the input control signal to a hydraulic control 176. As discussed above with respect to control 118 of FIG. 6, the electrical input signal to control 176 will result in the movement of a slide valve which determines, in accordance with the polarity of the error signal, the direction of flow to jack 74 and thus the direction of movement of the piston therein. The control action will continue until the spout 24 has been repositioned so as to make the angle $\beta$ equal the angle $\alpha$ whereupon the error signal appearing at the output of comparator 174 will be nulled. As also discussed above, the magnitude of the error signal applied to the servo hydraulic control 176 will also determine the rate of delivery of the hydraulic fluid to jack 74 and thus the speed at which the spout 24 is repositioned.

When control device 166 is caused to perform a conical precession movement, the end of the control device will pivot at the level of the Cardan joint 170 about axes $X_1$ and $Y_1$. These continued movements will cause the hydraulic circuits associated with jacks 74 and 80 to function continuously and, accordingly, the discharge end of spout 24 to be scanned along a preselected trajectory.

The embodiment of FIGS. 7–11 has the advantage that, since the control device 166 is mechanically isolated from the suspension system for spout 24, safety devices such as those described above in the discussion of FIGS. 3–5 are not required.

The present invention is applicable to all of the constructional versions of the control system of co-pending application Ser. No. 288,974 including those in which the suspension and control system are installed at an angle with respect to the furnace axis.

While preferred embodiments have been shown and described, various modifications and substitutions may be made thereto without departing from the spirit and scope of the invention. Accordingly, the present invention has been described by way of illustrations and not limitation.

What is claimed is:

1. Apparatus for controlling the movements of an elongated member positioned within an enclosure, the movable member having a first longitudinal axis and being pivotally supported ajacent its first end, the pivotal support permitting rotation of the member about a second axis transverse to the first longitudinal axis, the pivotal support defining a third axis which intersects the first and second axes, the pivotal support being rotatable about the third axis, said control apparatus comprising:

control means, said control means being located to the exterior of the enclosure, said control means including a control device defining a fourth axis, said control means further including means supporting said control device being supported for oscillatory movement about fifth and sixth axes which intersect said fourth axis whereby said control device has the same degree of freedom of movement as the elongated member which is to be controlled;

means for imparting movement to said control device to cause said control device fourth axis to undergo the angular movements with respect to said fifth and sixth axes it is desired to impart to the elongated member first axis respectively with respect to said second and third axes;

first actuator means for causing the elongated member to pivot about the second axis;

second actuator means for causing the pivotal support of the elongated member to pivot about the third axis;

means for sensing differences between the angular orientation of said control device fourth axis with respect to said fifth and sixth axes and respective of the angular orientation of the elongated member first axis with respect to the second and third axes and for generating signals commensurate with said differences in between control device and elongated member angular orientation; and means responsive to said signals commensurate with differences in angular orientation for energizing respective of said first and second actuator means to null the angular orientation differences.

2. The apparatus of claim 1 wherein said first actuator means comprises:

a first hydraulic jack, said first jack having a reciprocal output member;

means mounting said first hydraulic jack on the pivotal support, said mounting means permitting rotation of said first jack about an axis which is parallel to said fifth axis; and means mechanically coupling said first jack reciprocal output member to the elongated member.

3. The apparatus of claim 2 wherein said second actuator means comprises:

a second hydraulic jack, said second jack having a reciprocal output member;

a fixed support for said second hydraulic jack; and means coupling said reciprocal output member of said second jack to the pivotal support, said coupling means defining an articulated connection whereby the pivotal support may be caused to oscillate about the third axis.

4. The apparatus of claim 1 wherein said control means control device comprises:

an elongated arm; and wherein said control means supporting means comprises:

a rotary shaft, said arm being affixed to said rotary shaft for movement therewith; and means for rotatably supporting said rotary shaft on the pivotal support for the elongated member, said rotary shaft being oriented parallel with respect to the second axis.

5. The apparatus of claim 3 wherein said control means control device comprises:

an elongated arm; and wherein said control means supporting means comprises:

a rotary shaft, said arm being affixed to said rotary shaft for movement therewith; and means for rotatably supporting said rotary shaft on the pivotal support for the elongated member, said rotary shaft being oriented parallel with respect to the second axis.

6. The apparatus of claim 5 wherein said means for coupling the reciprocal output member of said first actuator means hydraulic jack to the elongated member is coupled to said arm at a point displaced from said rotary shaft.

7. The apparatus of claim 5 wherein said means supporting said rotary shaft on the pivotal support permits relative movement between said rotary shaft and said control device arm and wherein said means for sensing differences in angular orientation each comprise:

sensor means for detecting relative movements between said control device arm and rotary shaft.

8. The apparatus of claim 7 wherein said means supporting said rotary shaft on the pivotal support comprises universal joint means.

9. The apparatus of claim 8 wherein said universal joint means comprises a Cardan joint.

10. The apparatus of claim 1 further comprising:

means for detecting differences in angular orientation in excess of a predetermined mininum and for generating signals commensurate therewith; and means responsive to a signal indicative of an excess angular orientation difference for disabling aid actuator means.

11. The apparatus of claim 8 wherein said universal joint means comprises:

resilient coupling means, said resilient coupling means releasing the mechanical connection between said rotary shaft and said control device arm in response to imposition of a force in excess of a predetermined minimum on said control means by the pivotal support.

12. The apparatus of claim 11 wherein said resilient coupling means comprises:

inner frame means, said inner frame means supporting said universal joint means;

outer frame means, said outer frame means being integral with said rotary shaft; and a plurality of elastic securing devices for normally retaining said inner frame within said outer frame.

13. The apparatus of claim 11 wherein said resilient coupling means comprises:

inner frame means, said inner frame means supporting said universal joint means;

intermediate frame means, said inner frame means being pivotally supported within said intermediate frame means;

outer frame means, said intermediate frame means being pivotally supported within said outer frame means, said outer frame means being affixed to said rotary shaft;

means elastically capturing said inner frame means within said intermediate frame means; and means for elastically capturing said intermediate frame means within said outer frame means.

14. The apparatus of claim 7 wherein said means for sensing differences in angular orientation comprises:

means for sensing the angular orientation of said control means control device fourth axis with respect to each of said fifth and sixth axes and for generating electrical signals commensurate therewith;

means for sensing the angular orientation of the elongated member first axis with respect to each of the second and third axes and generating electrical signals commensurate therewith;

comparator means responsive to the signals commensurate with angular orientation with respect to the second and fifth axes for providing a first error signal commensurate with any difference therebetween;

comparator means responsive to said signals commensurate with angular orientation with respect to the third and sixth axes for providing a second error signal commensurate with any difference therebetween;

means for delivering said first error signal as an energizing signal to said first actuator means; and means for delivering said second error signal as an energizing signal to said second actuator means.

15. The apparatus of claim 1 wherein the enclosure is a shaft furnace and wherein said controlled elongated member is a charge distribution spout.

16. The apparatus of claim 15 wherein said means for sensing differences in angular orientation comprises:

means for sensing the angular orientation of said control means control device fourth axis with respect to each of said fifth and sixth axes and for generating electrical signals commensurate therewith;

means for sensing the angular orientation of the elongated member first axis with respect to each of the second and third axes and generating electrical signals commensurate therewith;

comparator means responsive to the signals commensurate with angular orientation with respect to the second and fifth axes for providing a first error signal commensurate with any difference therebetween;

comparator means responsive to said signals commensurate with angular orientation with respect to the third and sixth axes for providing a second error signal commensurate with any difference therebetween;

means for delivering said first error signal as an energizing signal to said first actuator means; and means for delivering said second error signal as an energizing signal to said second actuator means.

17. The apparatus of claim 15 wherein said control means control device comprises:

an elongated arm; and wherein said control means supporting means comprises:

a rotary shaft, said arm being affixed to said rotary shaft for movement therewith; and means for rotatably supporting said rotary shaft on the pivotal support for the elongated member, said rotary shaft being oriented parallel with respect to the second axis.

18. The apparatus of claim 17 wherein said means supporting said rotary shaft on the pivotal support permits relative movement between said rotary shaft and said control device arm and wherein said means for sensing differences in angular orientation each comprise:

sensor means for detecting relative movements between said control device arm and rotary shaft.

19. The apparatus of claim 18 further comprising:

means for detecting differeces in angular orientation in excess of a predetermined minimum and for generating signals commensurate therewith; and means responsive to a signal indicative of an excess angular orientation difference for disabling said actuator means.

* * * * *

UNITED STATES PATENT AND TRADEMARK OFFICE

CERTIFICATE OF CORRECTION

PATENT NO. : 4,493,600

DATED : January 15, 1985

INVENTOR(S) : Edouard Legille et al

It is certified that error appears in the above-identified patent and that said Letters Patent are hereby corrected as shown below:

Title should read --CHUTE CONTROL FOR FURNACE CHARGING SYSTEM--.

Col. 12, line 30, after "disabling", "aid" should be --said--.

Signed and Sealed this

*Tenth* Day of *June 1986*

[SEAL]

*Attest:*

DONALD J. QUIGG

*Attesting Officer*

*Commissioner of Patents and Trademarks*